United States Patent [19]

Mitts et al.

[11] Patent Number: 4,756,054

[45] Date of Patent: Jul. 12, 1988

[54] TIP OUT HINGE

[75] Inventors: Richard K. Mitts, Fullerton, Calif.; J. Kevin Jones, Jeffersontown, Ky.

[73] Assignee: Rev-A-Shelf, Jeffersontown, Ky.

[21] Appl. No.: 30,224

[22] Filed: Mar. 25, 1987

[51] Int. Cl.[4] ..... E05D 7/04; E05F 1/14

[52] U.S. Cl. ..... 16/237; 16/288; 16/294; 16/304; 16/368; 16/370

[58] Field of Search ..... 16/235, 237, 236, 248, 16/286, 287, 288, 289, 294, 302, 304, 368, 370

[56] References Cited

U.S. PATENT DOCUMENTS

| | | | |
|---|---|---|---|
| 3,003,495 | 10/1961 | Coultrip | 126/194 |
| 3,224,036 | 12/1965 | Himes | 16/190 |
| 3,370,318 | 2/1968 | Marchione | 16/145 |
| 4,068,348 | 1/1978 | Chivers | 16/129 |
| 4,091,498 | 5/1978 | Lautenschlager | 16/128 |
| 4,590,641 | 5/1986 | Lautenschlager | 16/238 |

FOREIGN PATENT DOCUMENTS

| | | | |
|---|---|---|---|
| 2752186 | 6/1979 | Fed. Rep. of Germany | 16/370 |
| 3309977 | 9/1984 | Fed. Rep. of Germany | 16/288 |

OTHER PUBLICATIONS

Finney Manufacturing Co., brochure, undated.

Vogt Industries, brochure, undated titled "Number 96–94 Sink Front Storage System".

*Primary Examiner*—M. Jordan

*Assistant Examiner*—Edward A. Brown

*Attorney, Agent, or Firm*—Scott R. Cox

[57] ABSTRACT

This invention discloses a tip out hinge specifically designed for use with a storage container located within a cabinet. The tip out hinge provides easy access to the contents of a storage container located within a cabinet. For example, the tip out hinge is used in a tip out storage container in a bathroom for clothing or bathroom items. It also provides access to a storage facility located behind a false front in a bathroom or kitchen. The tip out hinge permits the storage unit to tip forward from the cabinet, remain open until closing begins, remain closed even when bumped, provide a large opening for easy access to the storage container and will not interfere with the operation of any doors or drawers located below the tip out storage container.

11 Claims, 2 Drawing Sheets

TIP OUT HINGE

BACKGROUND OF INVENTION

1. Field of Invention

This invention relates to hinges. In particular, this invention relates to a tip out hinge which would permit a storage container located within a cabinet to be tipped forward out of the cabinet.

2. Prior Art

In an effort to more fully utilize all available space in a kitchen or bathroom cabinet or storage closet, various devices have been designed. For example, rotating "Lazy Susan" type assemblies utilize the "dead" space located in a corner kitchen cabinet.

Another frequently under utilized storage area in a kitchen or bathroom cabinet is the area behind a false front. A conventional drawer cannot be used to provide storage for this area because of the close proximity of a sink. One means of solving this problem and utilizing this storage space is to attach a storage tray to the inside of the false front, and install hinges on the bottom of the false front to allow the false front to be tipped forward, thus providing access to the area behind the false front.

In prior art false front storage devices, the false front swings downward on conventional hinges which are attached to the bottom of the false front and the inside surface of the cabinet opening. The degree of opening of the false front is usually limited by a chain or other such device secured to the inside surface of the false front and the inside of the cabinet opening. With this type of chain arrangement, the opportunity for breakage or damage to the false front is great. Also, there is no means to mechanically return the false front to its closed position once closing has begun or to hold in its closed position after it is closed. In addition, the access to the storage area may be quite limited, especially if the cabinet has an extended surface lip.

In an attempt to solve some of these problems with false front storage systems, Vogt Industry, Inc. has designed a system which is disclosed in a brochure, "*Number* 96–94 *Sink Front Storage System.*" While the Vogt sink front storage system does provide a storage system for use with false fronts, it has several serious limitations. There is no mechanism in the Vogt device to mechanically return the storage system to its closed position once closing begins or to hold it closed after closing. Further, the bottom lip of the Vogt sink front drops during the operating cycle. Since it drops at least an inch while it is being opened, the sink front will frequently interfere with the opening and closing of any cabinet doors located below the sink front. The sink front frequently collides with these doors causing damage to both the false front and the doors. An additional deficiency is the limit on the angle of the opening of the sink front. Because of functional limitations in the Vogt system, the angle of opening of the sink front is limited to about twenty degrees. When the cabinet has an extended surface lip, access to the storage tray behind the sink front is minimal. As a further deficiency, the system is designed to be used only with a rigid PVC storage tray whcih is located between the support brackets of the system. Thus, the system is not adaptable for use with other types of storage trays.

General cabinet-type hinges are disclosed in numerous patents including U.S. Pat. Nos. 4,068,348, 4,091,498, 3,370,318, 3,003,495, 4,590,641 and 3,224,036.

However, none of these hinges provide an improved tip out hinge for cabinet storage systems.

Therefore, it is an object of this invention to provide a tip out hinge for use in a storage system within a cabinet.

It is another object of this invention to provide a tip out hinge which will attach to a false front for the opening and closing of a false front.

It is a still further object of this invention to provide a tip out hinge for a tip out storage system which will not destructively interact with doors or shelves located below the storage system.

It is a still further object of this invention to provide a tip out hinge for a tip out storage system useful in a bathroom or kitchen cabinet.

These and other objects and features of the present invention will become apparent to those skilled in the art from a consideration of the following detailed description, drawings and claims. The description along with the accompanying drawings provide a selected example of construction of the device to illustrate the invention.

SUMMARY OF INVENTION

In accordance with the present invention, there is provided a tip out hinge for use within a cabinet comprising:

a. a base plate securable to a cabinet;
b. a pair of pivot bars rotatably secured to the base plate; and
c. a bracket secured to the plurality of rotatable pivot bars.

In an alternative embodiment, there is provided a tip out hinge for use within a cabinet comprising:

a. a base plate securable to the frame of a cabinet;
b. a pair of pivot bars rotatably secured to the base plate;
c. a bracket secured to the plurality of rotatable pivot bars; and
d. a spring secured between the base plate and one of the pivot bars.

This tip out hinge can provide a safe, reliable means for securing a tip out storage system within a cabinet to provide additional storage space that combines the advantages of tipping out from the front of the unit, returning the storage system to a closed position once the storage system is partially closed and remaining closed until opened. Because of its unique mechanical construction, it also will not interfere with the operation of any doors or drawers of the cabinet located below the tip out storage unit.

BRIEF DESCRIPTION OF THE DRAWINGS

The invention will now be described with reference to the accompanying drawings in which.

DETAILED DESCRIPTION OF PREFERRED EMBODIMENT

Figure 1:
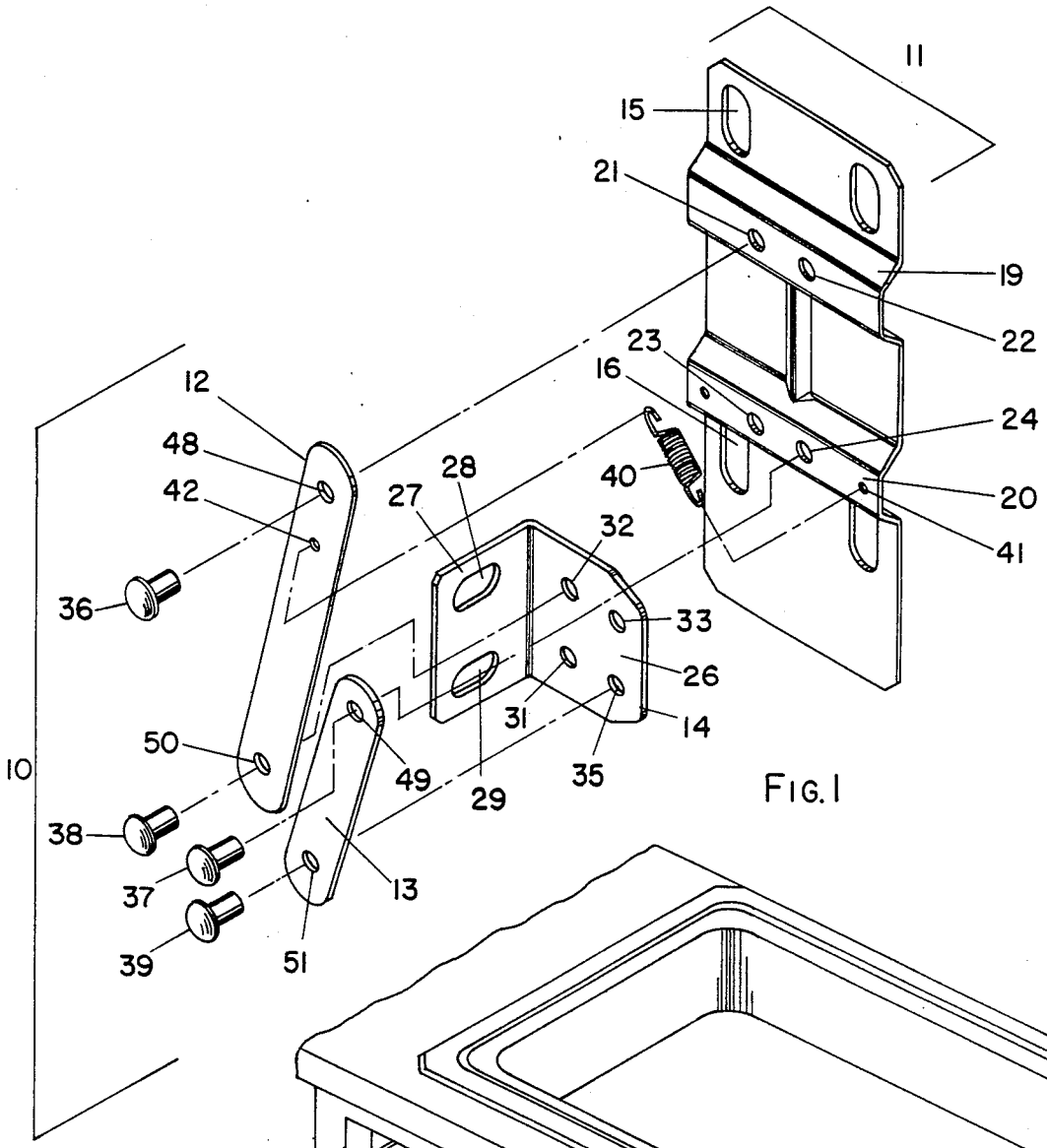
FIG. 1 is a exploded view of a left side tip out hinge.
Figure 2:
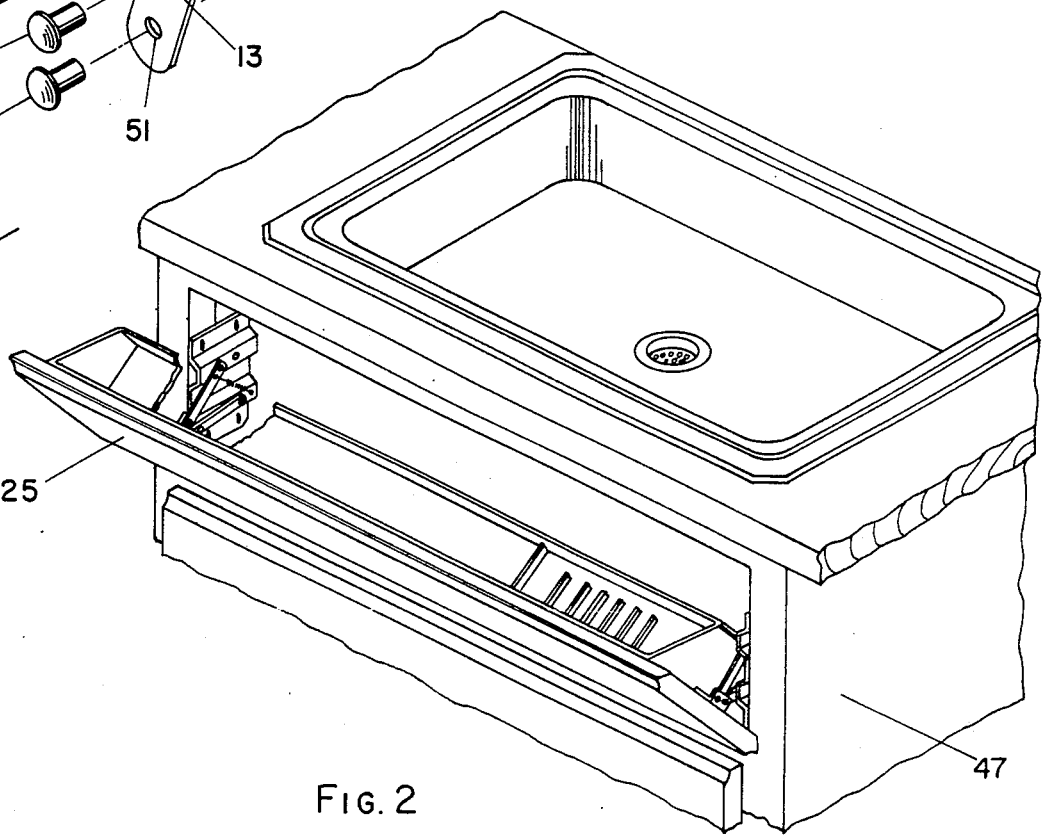
FIG. 2 is a front prospective view of the left side tip out hinge connected to a false front in operation in a cabinet.

Although the invention is adaptable to a wide variety of uses, it is shown in the drawings for the purpose of illustration as embodied in a tip out hinge (10) comprised of a base plate (11), two pivot bars; a first pivot bar (12) and a second pivot bar (13), rotatably secured to the base plate and a bracket (14) secured to the pivot bars, See FIGS. 1 and 2. It is understood that although this tip out hinge can be used in many types of storage facilities, such as storage cabinets in a bathroom or kitchen or in other storage locations where it is important that the storage container tilt out of the cabinet, in a preferred embodiment, the hinge supports a false front (25) located in front of a sink.

The base plate (11) is generally a flat rectangular plate taller than it is wide. The height and width of the base plate can be any convenient size sufficient to support the tip out hinge (10) and the storage container (43) attached to the false front. In a preferred embodiment the base plate is from about 2 to about 5 inches in height and from about 1 to about 3 inches in width.

The base plate is secured to the opening in the cabinet by securing means passing through a set of openings, one near the top (15) and the second near the bottom of the base plate (16). Each of these openings is vertically oblong in shape to allow for minor adjustments in the height of the base plate when it is being secured to the cabinet opening. Although only the top (15) and bottom (16) openings in the base plate are necessary to secure the base plate to the opening in the cabinet, two parallel sets of openings are preferably provided so the base plate may be used on either side of the cabinet opening. See FIGS. 3 and 4. The base plate can be secured to the frame of the cabinet by any conventional securing means, such as a pair of wooden screws or bolts (17,18). The base plate can be manufactured from any conventional material commonly used for the manufacture of hinges, such as steel, heavy duty plastic or other conventional materials.

Although the base plate is generally flat, two horizontal, raised sections, an upper raised section (19) and a lower raised section (20), each containing a flat surface running the width of the base plate are provided. These two horizontal, raised sections effectively divide the base plate into three rectangular flat sections. See FIGS. 3 and 4. In the flat surface of each of these raised surfaces are located a pair of openings, two in the upper raised section (21, 22) and two in the lower raised section (23, 24). The two openings in the lower raised section (23, 24) are directly below the two openings in the upper raised section (21, 22).

The first pivot bar (12) is secured through one of the openings in the upper raised section and the second pivot bar (13) is secured through the opening in the lower raised section which is diagonal to the opening used for securing the first pivot bar. See FIGS. 1 and 3. For example, when the first pivot bar (12) is secured to the base plate (11) through the upper left opening (21) in the upper raised section (19), the second pivot bar (13) is secured to base plate (11) through the lower right opening (24) in the lower raised section (20). The other two diagonal openings (22, 23) are used to secure pivot bars to a base plate for use with a tip out hinge for the opposite side of the opening in the cabinet.

The pivot bars (12, 13) are secured to the base plate (11) by any conventional fastening means which allows them to rotate about the axis of that fastening means. In a preferred embodiment, the pivot bars are secured to the base plate by rivets (36, 37) running through both the base plate and openings (48, 49) in the first end of the pivot bars. However, it is critical that the rivets allow the pivot bars to rotate freely about the axis of the rivets. Although the length of the pivot bars is not critical, the first pivot bar (12) preferably is about ½ to about ⅔ of the height of the base plate (11) and the second pivot bar (13) is preferably about ⅓ to about ½ of the height of the base plate and is shorter then the first pivot bar. Both pivot bars preferably are about ¼ to about ½ of an inch in width. Although the width of the pivot bar is not critical, each should be slightly wider than the distance between the center of the two openings (21, 22) or (23, 24) in either of the two raised sections (19, 20) of the base plate (11) and each of the pivot bars should be approximately the same width. In a more preferred embodiment, the first pivot bar (12) is from about 2 to about 4 inches in length and the second pivot bar (13) is from about ¾ to about 2 inches in length, with the first pivot bar (12) at least about 30 percent longer than the second pivot bar (13). The length, width and strength of these pivot bars should be determined by the weight and stress created by the particular storage use chosen.

Secured to the end of each of the pivot bars opposite where they are secured to the base plate is the bracket (14) to which a storage container or false front (25) is secured. In a preferred embodiment, the bracket is L-shaped, formed from a generally rectangular metal plate which has been broken at a 90 degree angle to form two perpendicular portions (26, 27) of the bracket. When secured to the pivot bars, one of the two portions (26) of the L shaped bracket is parallel to the base plate and the other portion (27) projects approximately perpendicular to the surface of the base plate (11).

Figure 5:
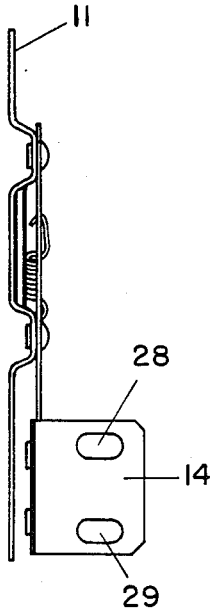
FIG. 5 is a side view of the left side tip out hinge in its closed position.
Figure 6:
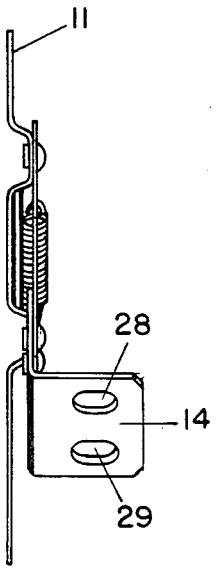
FIG. 6 is a side view of the left side tip out hinge in its open position.

Although the size of the bracket (14) is not critical, it should be of sufficient size and strength to support the storage container or false front which is used. In a preferred embodiment, when attached to a false front (25), each of the two portions (26, 27) of the bracket is from about ½ to about 2 inches in length and from about ½ to about 2 inches in width. That portion of the bracket which is perpendicular to the base plate (27) contains a pair of oblong shaped openings (28, 29). See FIGS. 5 and 6. By using this oblong shape, minor adjustments can be made when securing the false front to the bracket. The false front is secured through these openings (28, 29) to the hinge by any conventional securing means such as wood screws or bolts, and in a preferred embodiment the securing means is a pair of wood screws, (30, 31).

The portion of the bracket (26) which is parallel to the base plate contains four openings, (32, 33, 34, 35) two of which are used to secure the second end of each of the pivot bars to the bracket. See FIGS. 1, 3 and 4. The openings in the bracket which are used to secure each of pivot bars to the bracket are located diagonally across from each other. For example, in a left side bracket, the second end of the first pivot bar is secured to the opening which is both at the top and nearest the perpendicular section of the bracket (32). The second end of the second pivot bar is secured through the opening (35) diagonal from the opening for the first pivot bar.

The four openings in the bracket are provided to allow the bracket to be used on either side of the cabinet opening. The four openings are approximately equal distance away from each other and from the edge of the bracket. The pivot bars are secured to the brackets through openings (50, 51) in the second end of the pivot bars by any conventional securing means which will allow the pivot bars to rotate. In a preferred embodiment the pivot bars are secured by rivets (38, 39) running through the second ends of the pivot bars and the bracket.

Figure 3:
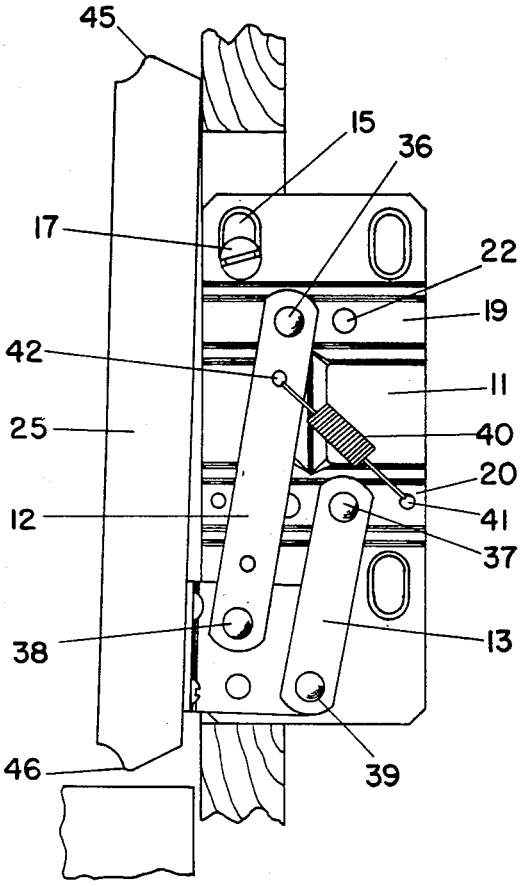
FIG. 3 is a front view of the left side tip out hinge secured in its closed position within a cabinet with a false front secured to a bracket of the hinge.
Figure 4:
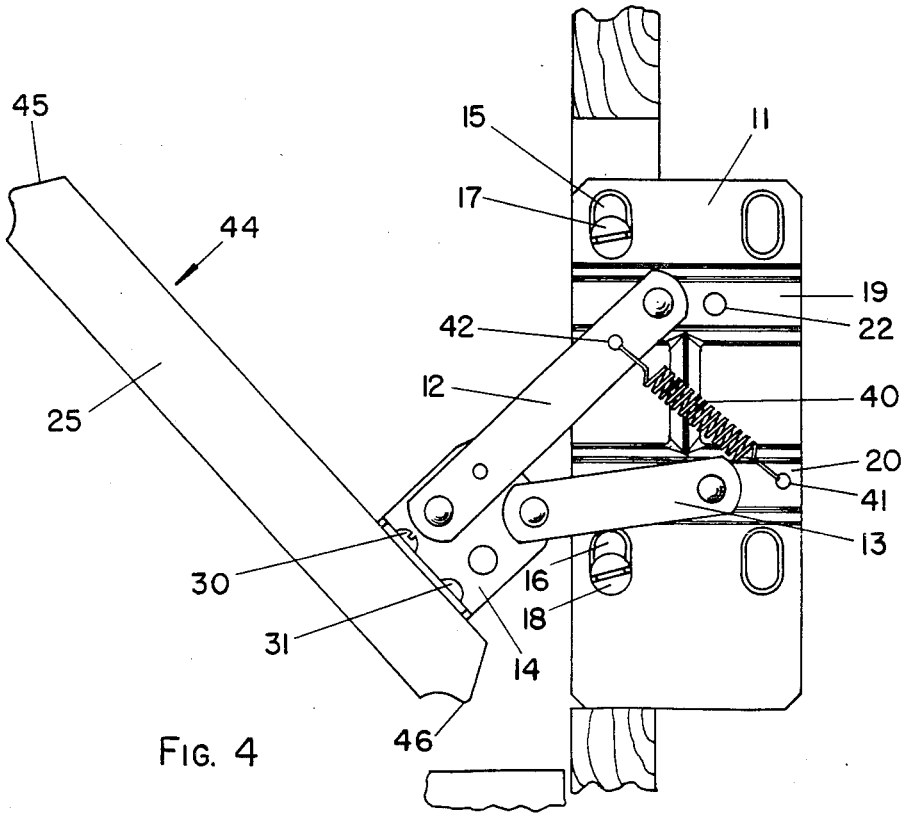
FIG. 4 is a front view of the left side tip out hinge secured in its open position within a cabinet with a false front secured to a bracket of the hinge.

The location of the openings in the raised section of the base plate (21, 22, 23, 24), the length and width of the pivot bars (12, 13) and the location of the openings in the bracket (32, 33, 34, 35) are arranged in such a fashion that the rotation of the pivot bars is limited, Compare FIGS. 3 and 4. Because of this arrangement, the first pivot bar (12) is limited in rotation from its closed position to about 15 to about 90 degrees about the axis running through the securing means of the first end of the first pivot bar. Although the rotation of the second pivot bars is greater than the rotation of the first pivot bar, is it also limited in rotation from its closed position to about 25 to about 115 degrees about the axis of the securing means of the first end of the second pivot bar.

As the hinge is opened, the perpendicular surface of the bracket rotates. (See FIGS. 3 and 4). Just as the degree of rotation of the pivot bars is limited, the degree of rotation of the bracket is limited to about 15 to about 90 degrees about the axis the securing means of the first pivot bar. The pivot bars are secured to the base plate in such a fashion that when the hinge is in its closed position, the perpendicular face of the bracket rotates slightly, i.e., from about 1 to about 5 degrees past vertical. See FIG. 3. This excess rotation helps to keep the storage unit closed.

Although the hinge will work properly without the addition of a spring, in a preferred embodiment a spring (40) is added to the tip out hinge to hold the hinge in a closed position and to return it to that closed position once closure of the storage container begins. The spring is secured to the base plate (11), through an opening (41) in the lower of the two raised sections (20) on the same side of the base plate as is the rivet securing (37) the second pivot bar in a left side bracket and near the end of that raised section. The other end of the spring is secured through an opening (42) in the first pivot bar within about ⅛ to about 1 inch of the first end in the first pivot bar. See FIG. 3. This spring can be of any conventional spring structure of sufficient quality and strength to repetitively return the false front to its closed position.

In operation, two tip out hinges are secured to the inside frame of a cabinet opening, one on each end. A false front (25) is secured to the brackets of the tip out hinges. A storage container (43) is secured to the inside surface (44) of the false front by a securing means such as screws, bolts or other conventional securing means to provide storage space within the cabinet (47). See FIG. 2. As FIG. 4 shows, upon opening of the false front, the top lip (45) of the false front tips out from the cabinet (47) while the bottom lip (46) of the false front both raises and comes forward slightly from the cabinet (47). This movement creates increased access to the storage container within the cabinet over prior art containers.

Although the preferred use for the tip out hinge is with a false front, it can easily be adapted for use to any storage container where tip out capability would be useful, such as in a bathroom cabinet or other types of storage facility, easily imagined by those skilled in the art.

We claim:

1. A tip out hinge for use within a cabinet comprising:
a. a base plate securable to the frame of the cabinet;
b. a first and second pivot bar rotatably secured to the base plate; and
c. a bracket secured to the first and second rotatable pivot bars, wherein when the hinge is in a closed position the upper ends of said first and second pivot bars are secured to the base plate and the lower ends of said pivot bars are secured to the bracket.

2. A tip out hinge for use within a cabinet comprising:
a. a base plate securable to the frame of a cabinet;
b. a first and second pivot bars rotatably secured to the base plate;
c. a bracket secured to the first and second rotatable pivot bars wherein when the hinge is in a closed position the upper ends of said first and second pivot bars are secured to the base plate and the lower ends of said first and second pivot bars are secured to the bracket; and
d. a spring secured between the base plate and one of the pivot bars.

3. A storage system secured within a cabinet by a pair of tip out hinges comprising:
a. a pair of base plates, one secured to each side of an opening in a cabinet;
b. two pairs of first and second pivot bars, each pair rotatably secured to one of the base plates;
c. a pair of brackets, one secured to each pair of first and second pivot bars wherein when the hinge is in a closed position the upper ends of each said first and second pivot bars are secured to one of the base plates and the lower ends of each said first and second pivot bars are secured to one of the brackets;
d. a false front securable to the pair of brackets; and
e. a storage container securable to the false front.

4. A storage system secured within a cabinet by a pair of tip out hinge comprising;
a. a pair of base plates, one secured at each end of an opening in the cabinet;
b. two pairs of first and second pivot bars, each pair rotatably secured to one of the base plates;
c. a pair of brackets, one secured to each pair of first and second rotatable pivot bars wherein when the hinge is in a closed position the upper ends of each of said first and second pivot bars are secured to the base plates and the lower ends of each pair of first and second pivot bars are secured to one of the brackets.
d. a pair of springs, one secured between one of the base plates and one of the pivot bars attached to that base plate;
e. a false front securable to the pair of brackets; and
f. a storage container securable to the false front.

5. The tip out hinge as in any of claims 1, 2, 3 or 4 wherein the bracket is L shaped.

6. The tip out hinge as in any of claims 1 or 2 wherein the bracket is attached to a false front.

7. The tip out hinge as in any of claims 1, 2, 3 or 4 wherein the pivot bars are rotatably secured by rivets to the base plate.

8. The tip out hinge as in any of claims 1, 2, 3 or 4 wherein the first pivot bar is at least about 30 percent longer than the second pivot bar.

9. The tip out hinge as in any of claims 1, 2, 3 or 4 wherein the first pivot bar is about 2 to about 4 inches in length, the second pivot bar is about ¾ to about 2 inches in length and the first pivot bar is at least 30 percent longer than the second pivot bar.

10. The tip out hinge as in any of claims 1 or 2 which can be used on the right side or on the left side of a cabinet opening.

11. The storage system as in any of claims 3 or 4 wherein the storage container is securable within a bathroom or kitchen cabinet.

* * * * *